United States Patent [19]

Berg

[11] 3,979,146

[45] Sept. 7, 1976

[54] BEACH CLEANING APPARATUS

[76] Inventor: Robert M. Berg, 5250 James Ave. No., Minneaolis, Minn. 55430

[22] Filed: June 19, 1975

[21] Appl. No.: 588,321

[52] U.S. Cl. ..... 294/55; 294/1 R; 294/57; 209/419; 15/257.1; 294/19 R; 56/400.11

[51] Int. Cl.[2] ..... A01B 1/02

[58] Field of Search ..... 294/55, 51, 59, 26.5, 294/19 R, 1, 49, 57, 60, 67 D, 67 DA, 67 DC; 56/400.8, 400.11, 400.13; 15/257.1, 257.4, 257.5, 257.7, 257.9; 209/417, 418, 419, 274, 281; 248/95, 97, 99, 100, 101; 220/19, 94 R; 190/49, 57

[56] References Cited

UNITED STATES PATENTS

| | | | |
|---|---|---|---|
| 985,568 | 2/1911 | Conover | 294/55 |
| 1,141,423 | 6/1915 | Simas | 294/55 |
| 2,545,226 | 3/1951 | Claude | 294/55 |
| 3,627,368 | 12/1971 | Baughman | 294/55 |

*Primary Examiner*—James B. Marbert
*Attorney, Agent, or Firm*—Dugger, Johnson & Westman

[57] ABSTRACT

Beach cleaning apparatus that includes a generally U-shaped bracket that opens downwardly, a handle attached to the bracket to manually pull the bracket forwardly, an open mesh bag, fastener mechanism for releasably securing the adjacent parts of the mouth portion of the bag to the bracket, a knife blade extending between the legs of the bracket and a retainer bar secured to the bracket and knife blade for retaining the lower edge portion of the mouth of the bag therebetween. The mesh of the bag is of a size to permit passage of sand and small stones therethrough, but retain larger objects within the bag.

7 Claims, 6 Drawing Figures

10
22
21
22
F
18
19
4
4
11a
11b
3
19
15
11c
16
13
14
11d
15
3
18
11
19
20

21

13
18
14a
14
18a 20
19
18
22

43
18
5
42
41
10
5
43
42
18
41
5

14a
14
15

BEACH CLEANING APPARATUS

BACKGROUND OF THE INVENTION

A hand drawn tool for collecting debris and litter. In the prior art there are provided shovels having openings to permit the passage of smaller objects therethrough, for example U.S. Pat. Nos. 662,284 and 751,197. However, with such shovels, separate receptacles have to be provided for receiving debris collected, and more bending of the body is involved than desired, particularly for older people who no longer are as agile as they used to be. Further there are machine drawn devices for cleaning beaches, for example, U.S. Pat. No. 3,142,341; however, such are relatively expensive.

In order to overcome problems such as the above, as well as others, this invention has been made.

SUMMARY OF THE INVENTION

Beach cleaning apparatus that includes a generally U-shaped bracket that opens downwardly, a handle secured to the bracket to extend upwardly and forwardly thereof for manually pulling the bracket forwardly, an open mesh bag, a retainer bar and knife blade mounted by the lower ends of the bracket legs and mounting the lower mouth edge portion of the bag with the bag extending rearwardly of the bracket, and fastener mechanism for securing parts of the bag mouth portion adjacent the bracket to the bracket.

Figures 1, 2, 3, 4, 5, 6:
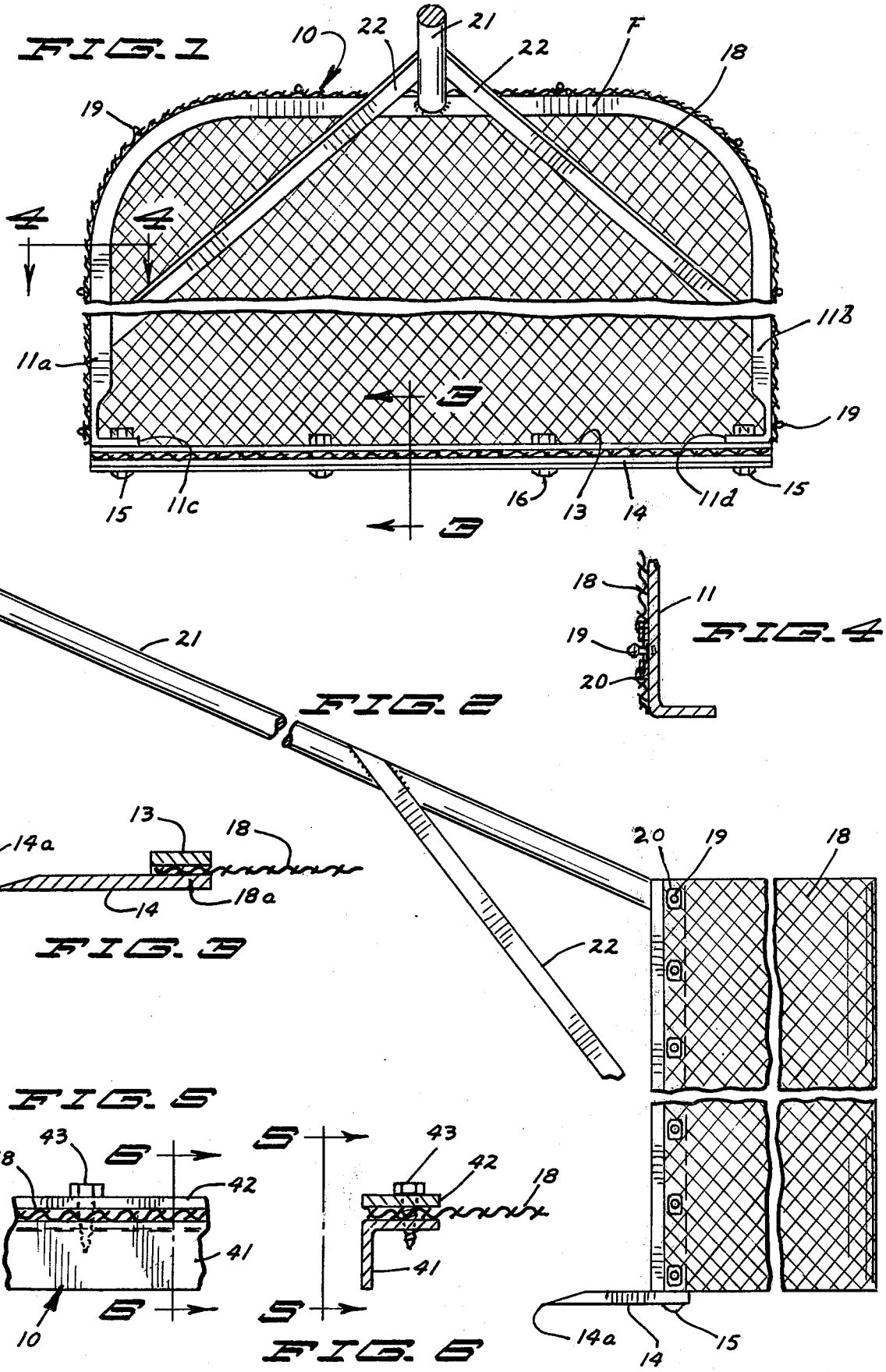
FIG. 1 is a front elevational view of the first embodiment of the beach cleaning apparatus of this invention with a vertically intermediate part and the handle being broken away.
FIG. 2 is a side view of the apparatus of FIG. 1 in a normal position of use, other than the bag thereof is shown in a non-collapsed condition, and portions broken away.
FIG. 3 is a cross-sectional view generally taken along the line and in the direction of arrows 3—3 of FIG. 1 to more clearly show the mounting of the lower mouth edge portion of the bag.
FIG. 4 is a fragmentary cross-sectional view generally taken along the line and in the direction of arrows 4—4 of FIG. 1 to more clearly show one way of securing the bag to the bracket.
FIG. 5 is a fragmentary front view, generally taken along the line and in the direction of arrows 5—5 of FIG. 6 of the second embodiment of the invention, to illustrate a second way of securing the bag to the bracket.
FIG. 6 is a fragmentary cross-sectional view generally taken along the line and in the direction of the arrows 6—6 of FIG. 5.

Referring now in particular to FIGS. 1–4, the first embodiment of the invention, generally designated 10, includes an open, generally rectangular frame F. The frame F includes a generally U-shaped rigid bracket 11 having depending legs 11*a*, 11*b*. The bracket may be made from an appropriate bent angle iron as illustrated, or may be of a tubular construction. The lower ends of the bracket legs are inturned toward one another at 11*c*, 11*d* to provide horizontal flanges.

Underlying the flanges 11*c*, 11*d* are a retainer bar 13 that forms part of the frame and a cutting blade 14 that has a front cutting edge 14*a* located forwardly of the retainer bar. Bolts 15 are extended through the transverse outer ends of the blade and retainer bar and the adjacent flange and have nuts threaded thereon for mounting the bar and blade on the bracket with the bar abutting against the flanges. Additional bolts 16 may be provided for securing the intermediate parts of the bar and blade together, the bolts being extended through the rear portion of the blade.

The lower mouth edge portion 18*a* of an open mesh fabric (woven or non-woven) bag 18 is extended between and clamped between the retainer bar and blade. The remainder of the mouth portion of the bag is secured to the U-shaped bracket by pins 19 secured to the bracket to extend outwardly thereof and have circumferential grooves adjacent the bracket. The said remainder of the mouth portion (sides and top portion) have grommets 20 that include spring members extending across the apertures thereof for resiliently abutting against the pin grooved portions to retain the grommets on the pins with the mouth portion against the bracket but at the same time permit the easy removal of the mouth portion from the pins. Advantageously, a band of cloth can be secured (sewn or otherwise suitably adhered) to the mouth portion of the bag for mounting the grommets and having apertures for bolts 15, 16 to extend through. The pins and grommets are of conventional structure for releasably mounting fabric on other structure and thus will not be further described.

The cross-sectional area of the bag mouth in an open condition is sufficiently larger to permit the bag being mounted on the frame as above described, and the bag is of a size to extend a substantial distance rearwardly of the frame. Preferably the bag is made of a fabric material that is collapsible, i.e., non-self-sustaining, for example, burlap material or plastic material. Additionally, the mesh is of a size to permit sand and small stones to pass therethrough but block the passage of larger size stones or objects therethrough, for example, about ⅛ inch to ¼ inch mesh, although it may be of a slightly larger mesh.

A handle 21 has one end secured to the mid-portion of the web of the bracket to extend upwardly and forwardly thereof. The handle is of a length that the user in a generally upright condition can easily grasp the handle and pull the tool while maintaining the bracket generally perpendicular to the horizontal; or inclined slightly forwardly in an upward direction and the blade inclined slightly downwardly in a forward direction. Braces 22 have one ends secured to the handle in substantial spaced relationship to the bracket and opposite ends secured to the mid-portions of the bracket legs.

Referring to FIGS. 5 and 6, the second embodiment of the invention, generally designated 40, is of the same construction as the first embodiment except for the differences noted hereinafter. The second embodiment includes a U-shaped bracket 41 that is of the same construction as bracket 11 other than it does not have pins secured thereto, but rather has apertures for threadingly receiving metal screws 43. A generally U-shaped clamp band 42 is provided to clamp the side and top edge portions of the bag mouth against the transverse opposite surfaces of the legs of the bracket and the top surface of the web of the bracket. The screws 43 are threaded through the clamp band and bag and into the bracket for releasably securing the band to the bracket.

By having the lower edge portion of the bag extended between the retainer bar and blade, debris cannot catch on said lower edge portion as material moves over the knife and into the bag. Further, the bracket retains the mouth portion in an open condition even though the bag rearwardly thereof is in a collapsed condition, while as more material is moved into and retained in the bag, the bag gradually becomes fuller.

In pulling the tool of this invention along a beach, usually the blade is forced below the top surface of the sand. As a result, sand and debris on the beach moves over the blade and into the bag with the sand and small stones passing through the bag back onto the beach, but larger objects are retained in the bag. As more debris moves into the bag, it gradually piles up in the bag, including moving rearwardly in the bag. As a result, the user does not have to bend down or carry debris to a receptacle until it is desired to empty the bag; or preferably remove the bag with the debris therein and replace it with an empty bag. Further, with the cutting blade debris can be collected from small depressions in the surface by pulling the tool with the blade at the appropriate depth.

Additionally, the tool can be pulled under water to collect debris from the lake bottom. Additionally, due to the provision of the blade, weeds and other underwater plants can be cut, and if the plants are not too tall, such will be gathered in the bag as the tool is being pulled. Likewise, the tool will cut and gather weeds when being pulled along the shore of a lake or other body of water.

What is claimed is:

1. A tool for cleaning debris and litter from beaches and the like as it is pulled in a forward direction comprising an open, upright, generally rectangular frame having a top frame portion and a bottom frame portion, a manually pullable handle having one end portion secured to the top frame portion to extend upwardly and forwardly thereof, a blade having a front cutting edge, an open mesh collapsible bag having a mouth edge portion, said mouth edge portion having a lower mouth edge portion extended between the bottom frame portion and the blade, and top and side edge portions, means for removably securing the blade to the bottom frame portion with the lower mouth edge portion between the bottom frame portion and the blade and the cutting edge forwardly of the frame to mount the blade on the bottom frame portion and releasably clamp the lower mouth edge portion between the blade and the bottom frame portion, and means for removably fastening the bag mouth top and side edge portions to the frame to retain the bag mouth in an open condition with the bag extending rearwardly of the frame in a collapsed condition.

2. The apparatus of claim 1 further characterized in that said frame comprises a downwardly opening U-shaped bracket having a web portion and transversely spaced legs having lower ends, said web portion forming at least part of said top frame portion; and that said frame bottom portion comprises a retainer bar having transverse opposite ends.

3. The apparatus of claim 2 further characterized in that said securing means includes means for removably securing the retainer bar opposite ends and blade to the legs lower ends, and that the bag is of size to extend a substantial distance rearwardly of the frame.

4. The apparatus of claim 2 further characterized in that said bracket legs have transversely remote surfaces and said web has a top surface, that said mouth portion abuts against said remote surfaces and said top surface and that said fastening means comprises means for retaining said bag mouth portion in abutting relationship to said remote surfaces and top surface.

5. A tool for cleaning debris and litter from beaches and the like as it is manually pulled in a forward direction, a downwardly opening, generally U-shaped bracket having a web portion and legs that have lower end portions, a manually pullable handle secured to the web portion to extend upwardly and forwardly thereof, a blade having a front cutting edge, an open mesh collapsible bag having a mouth portion, said bag mouth portion having top, sides and lower edge portions, and means for removably securing the mouth portion and blade to the U-shaped bracket to retain the mouth in an open condition to have debris and litter that moves over the blade as the blade is moved forwardly passed into the bag and the bag to extend rearwardly of the bracket and blade in a collapsed condition.

6. The apparatus of claim 5 further characterized in that the securing means includes means for removably securing the blade to said lower end portions, and that said bag extends a substantial distance rearwardly of the bracket.

7. The apparatus of claim 6 further characterized in that said securing means includes a retainer bar extending between the leg lower end portions, that the bag mouth lower edge portion extends between the retainer bar and the blade, and that the securing means includes means for removably securing the blade and retainer bar together to retain the bag mouth lower edge portion therebetween and mount the retainer bar and blade on the lower end portions of the legs.

* * * * *